United States Patent [19]

Burke

[11] 3,995,765

[45] Dec. 7, 1976

[54] SAFETY CLOSURE FOR CONTAINERS

[75] Inventor: James E. Burke, Wheaton, Ill.

[73] Assignee: VCA Corporation, Baton Rouge, La.

[22] Filed: Dec. 18, 1974

[21] Appl. No.: 533,845

[52] U.S. Cl. ..... 220/281; 215/204; 215/208; 220/85 P; 220/306; 222/182

[51] Int. Cl.[2] ..... B65D 55/02; B67D 5/32; B65D 83/14

[58] Field of Search ..... 220/306, 281, 85 P; 215/9, 201–226; 222/153, 182

[56] References Cited

UNITED STATES PATENTS

| | | | |
|---|---|---|---|
| 3,425,578 | 2/1969 | Owens | 215/204 |
| 3,722,727 | 3/1973 | Gach | 215/9 |
| 3,750,817 | 8/1973 | Bozek | 215/208 |
| 3,802,607 | 4/1974 | Mead | 215/9 |
| 3,820,683 | 6/1974 | Jasinski | 220/306 |

*Primary Examiner*—George E. Lowrance
*Attorney, Agent, or Firm*—Donald L. Johnson; John F. Sieberth; E. Donald Mays

[57] ABSTRACT

A safety overcap for a container, for example, an aerosol container. The child-resistant overcap includes a generally circular top wall and a generally cylindrical outer skirt depending downwardly from the top wall. The wall of the outer skirt is provided with a pair of opposed, longitudinally extending slots. An inner skirt depends downwardly from the top wall within the outer skirt and has two opposed portions positioned adjacent the pair of openings in the outer skirt. The inner skirt is provided with opposed, inwardly projecting beads on the lower portion thereof which enagage an annular groove provided at the top of the container to attach the cap to the container. By gripping the exposed portions of the inner skirt through the slots with the forefinger and thumb and applying pressure thereto, the inner skirt is distorted and releases the overcap from the container.

7 Claims, 7 Drawing Figures

SAFETY CLOSURE FOR CONTAINERS

BACKGROUND OF THE INVENTION

1. Field of the Invention

This invention relates to a substantially child-resistant safety overcap particularly adapted for use on aerosol containers.

2. Description of the Prior Art

A wide variety of different types of closures for containers which carry toxic and harmful substances has been developed over the years. Recent Federal regulations have emphasized the need for simple, economical, childproof caps and closures for containers with harmful substances therein. Much effort has recently been devoted to perfecting suitable childproof overcaps for aerosol containers since these types of containers frequently carry such toxic materials as insecticides, fungicides, disinfectants, paints, lacquers, glass and metal cleaners, and numerous other substances which could be harmful to children if ingested by them.

Many of the previously proposed childproof overcaps, particularly overcaps for aerosol containers, are complicated in their manner of operation to the extent that they are difficult for adults to operate and thus have not found ready acceptance in the marketplace. Other types of overcaps are readily operable by adults, but are of complex construction, thus rendering them uneconomical to produce. Numerous child-resistant aerosol overcaps have been developed which require the use of extra tools or instruments, such as a screwdriver, for detaching the overcap from the container. These pose an inconvenience to the adult user and also may not be completely child-resistant. Safety caps using multiple components have not found ready acceptance because of the complexity of the caps and their high cost, together with the necessity of involving a substantial amount of hand labor or new machinery in assembling the caps and attaching them to the containers.

Therefore, it can be seen that there is a real need in the marketplace for a simple, economical, readily manufactured safety cap, particularly an overcap for an aerosol container, which obviates the disadvantages found heretofore in many of the prior art safety closures.

SUMMARY OF THE INVENTION

It is an object of the present invention to provide a child-resistant safety overcap for a container which can be readily removed by adults, but which resists removal by small children.

A further object of the present invention is to provide a child-resistant safety overcap for a container which utilizes a simple, one-piece construction and which is economical to manufacture.

Another object of the present invention is to provide a child-resistant safety overcap having means that are readily discernable to an adult, but not to a child, for removing the overcap from the container.

Other objects and advantages of the present invention will be readily apparent from the drawings and the following description.

The above and other objects of the present invention are realized in a child-resistant safety overcap for a container wherein the overcap has a generally circular top wall, a generally cylindrical outer skirt depending downwardly from the top wall, the outer skirt being provided with two opposed, longitudinally extending openings or slots therein. An inner skirt depends downwardly from the top wall within the outer skirt, two opposed portions of the inner skirt being positioned adjacent the two opposed openings in the outer skirt. Engaging means are provided on the inner skirt adjacent its lower end which are adapted to engage the container to retain the overcap thereon. The engaging means are disengageable from the container by application of inwardly directed force to the two opposed portions of the inner skirt which are accessible through the openings provided in the outer skirt.

DESCRIPTION OF THE PREFERRED EMBODIMENTS

Figure 1:
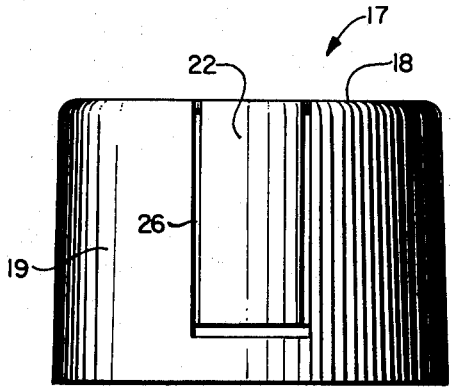
FIG. 1 is an elevational view of the safety overcap of the present invention.

The child-resistant safety overcap of the present invention is suitable for use on any container which provides an annular groove in the neck portion of the container. The present safety overcap may be used on bottles having grooves on the neck or on cans having grooved necks. The invention is particularly suited for use on aerosol-type containers, and the ensuing description, while not limited thereto, describes the child-resistant safety overcap in connection with its use on a pressurized aerosol-type dispenser can.

Referring now to FIGS. 1–3A, there is shown a pressurized aerosol dispenser container, designated generally by the numeral 10. The aerosol container includes a cylindrical sidewall 11, a bottom wall (not shown), and a top wall 12 which is attached to the sidewall by a rolled crimp or any other suitable means. The top wall 12 is provided with a generally annular, upwardly facing recess or groove 13 therein. The aerosol container 10 is provided with a dispensing valve and dip tube (not shown) having an upwardly projecting stem 14 with a conventional spray dispenser button 15 mounted thereon. The top wall 12 of the container is provided with an annular recess or groove 16 adjacent its upper end.

The child-resistant safety overcap, designated generally by the numeral 17, includes a generally circular top wall 18 and a generally cylindrical outer skirt 19 which may be integrally formed with and depend downwardly from the top wall. A generally elliptically shaped inner skirt 20 is preferably integrally formed with the top wall and depends downwardly therefrom and is spaced from and received substantially within the outer skirt 19. A pair of axially extending, opposed, integrally formed webs 21 and 21*a* may be provided, if desired, joining the inner and outer skirts. The wall of the outer skirt is provided with a pair of opposed, longitudinally extending, generally rectangular slots or openings 22 and 22*a*, which slots are located approximately 90 degrees from the position of the webs 21 and 21*a*. Openings 22 and 22*a* extend from the top wall downwardly in the outer skirt 19 and terminate at the location of the continuous, peripheral band 23 forming the lower portion of the outer skirt. The generally elliptically shaped inner skirt 22 is provided with generally rectangular pressure panels or portions 24 and 24*a* at the ends of its major axis. The pressure panels 24 and 24*a* are positioned adjacent to the respective openings 22 and 22*a* in the outer skirt. The maximum diameter of the inner skirt along the major axis is preferably slightly less than the inside diameter of the outer skirt to provide novel locating means for removal of the cap as will be described hereinafter. Arcuate recesses 26 and 26*a* may be provided in the top wall 18 at the juncture of the pressure panels 24 and 24*a* with the top wall.

Figure 2:
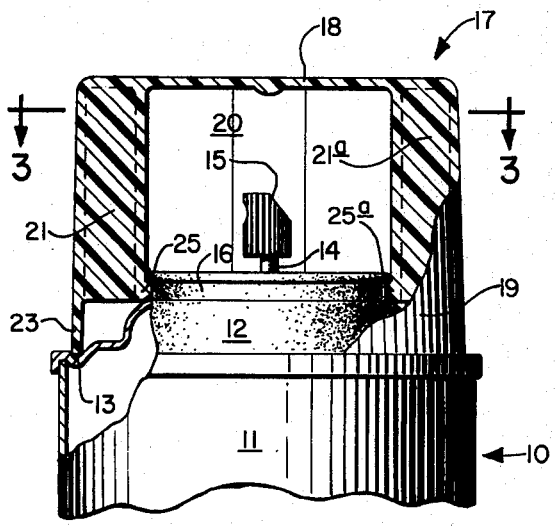
FIG. 2 is an elevational, partially broken view of the overcap of the present invention attached to an aerosol container.
Figure 3:
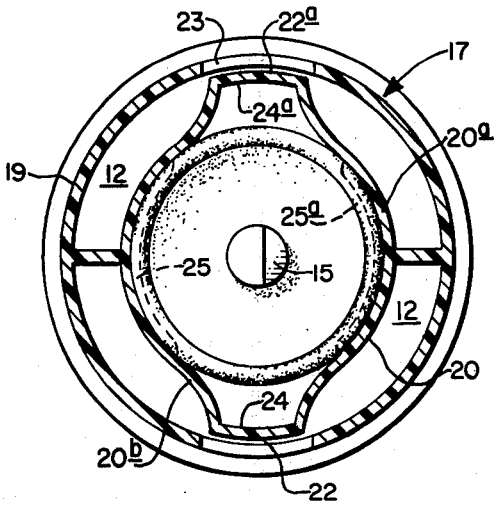
FIG. 3 is a cross-sectional view of FIG. 2 taken along line 3—3.

The inner skirt 20 is provided with a pair of opposed, inwardly projecting beads or detent means 25 and 25*a* integrally formed on its inner wall adjacent its lower end. If desired, the detent means may take the form of a series of protrusions rather than a continuous bead. As seen in FIGS. 2 and 3, when the overcap 17 is pressed onto the top of the aerosol container, the opposed beads 25 and 25*a* snap over the top of the container and are snuggly received in groove 16 in the top wall of the container to retain the overcap thereon.

Figure 3A:
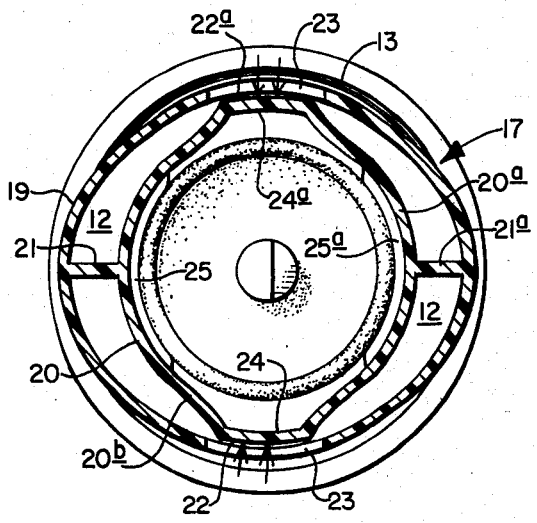
FIG. 3A is a cross-sectional view similar to FIG. 3 showing the position of the various elements of the overcap when pressure is applied to remove the overcap from the aerosol container.
Figure 4:
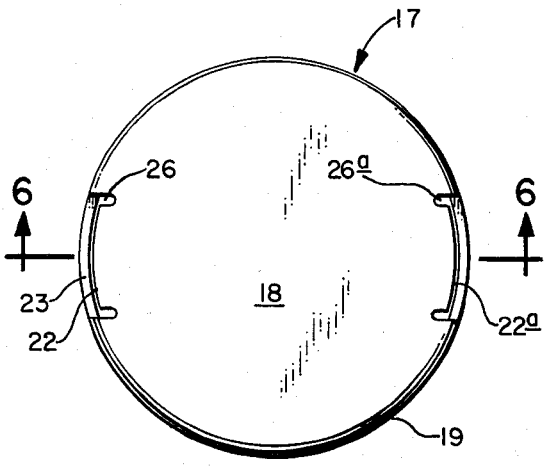
FIG. 4 is a top plan view of the safety overcap of the present invention.
Figure 5:
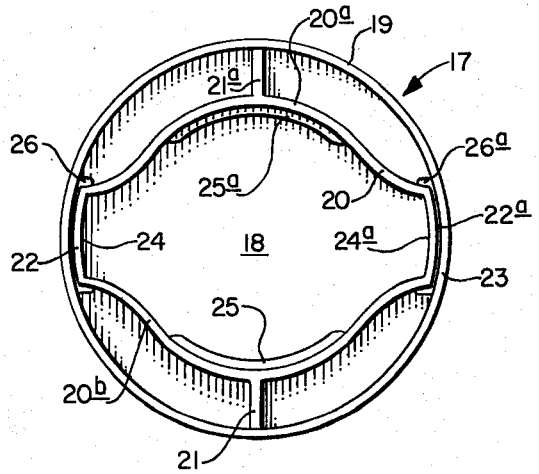
FIG. 5 is a bottom plan view of the safety overcap of the present invention.
Figure 6:
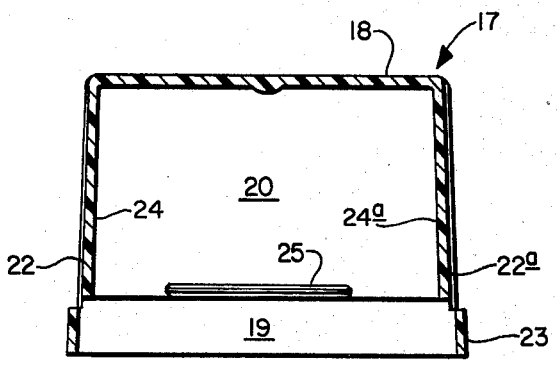
FIG. 6 is a cross-sectional view of the overcap taken along line 6—6 of FIG. 4.

To remove the overcap from the container, the thumb and forefinger are placed within the openings 22 and 22*a* provided in the outer skirt 19 and inwardly directed pressure is applied to the pressure panels 24 and 24*a* of the inner skirt which are exposed and accessible through the openings 22 and 22*a* in the manner shown in FIG. 3A. When squeezing pressure is applied to the pressure panels 24 and 24*a*, the two opposed, arcuately shaped sidewall portions 20*a* and 20*b* of the inner skirt are flexed outwardly thereby removing, or substantially removing, the beads 25 and 25*a* from the groove 16 in the top wall of the aerosol container as can be seen in FIG. 3A. The openings 22 and 22*a* on the outer skirt and the adjacent pressure panels 24 and 24*a* on the inner skirt are made of sufficient width so that they are adapted to receive the necessary portions of the thumb and forefinger of an adult to apply adequate pressure to flex the inner skirt and thereby permit removal of the overcap from the container.

As seen more clearly in FIG. 3, when pressure is applied to the pressure panels 24 and 24*a*, the arcuate portions 20*a* and 20*b* of the sidewall of the inner skirt act through webs 21 and 21*a* to also flex outwardly the corresponding opposite sidewall portions of the outer skirt 19. As can be seen, the inner skirt is deformed into a somewhat cylindrical configuration while the outer skirt assumes a somewhat elliptical configuration when pressure is applied to the pressure panels 24 and 24*a*. In the preferred form of the overcap-container combination, the peripheral lower end portion 23 of the outer skirt is snuggly received in the recess 13 in the top wall of the aerosol container as seen in FIG. 2. Thus, when pressure is applied to the pressure panels of the inner skirt, the outer skirt is distorted as described above which results in the lower edge of the outer skirt camming against the upwardly sloped surfaces of the groove 13 which results in forcing the overcap upwardly thereby assisting in disengaging the beads 25 and 25*a* from the recess 16.

While the overcap of the present invention can be made from metal in two or more pieces, i.e., the outer skirt and top wall as one piece and a separate inner skirt having a top wall which is subsequently attached to the underside of the top wall of the outer skirt as another piece, it is preferred to construct the overcap utilizing plastic materials to provide an integrally formed, one-piece safety overcap. The overcap may be conveniently formed by injection molding a suitable plastic material such as high or medium density polyethylene, polypropylene, polystyrene, polyvinyl chloride, ABS, polycarbonate, or other suitable plastic materials. The thicknesses of the sidewalls of the outer skirt and inner skirt will be determined to some extent by the physical characteristics of the plastic material utilized. It is necessary that the sidewall thickness and the physical characteristics of the plastic material be coordinated to provide the necessary degree of stiffness in the inner and outer skirts to provide the required spring action of the inner skirt to retain the overcap on the container and permit removal only by the application of pressure by the fingers of an adult. While it is quite unlikely that a child will be able to discern the manner in which the safety overcap can be removed from the container, nevertheless, by suitable choice of plastic material and thickness for the inner skirt, the inner skirt can be fabricated to have a flex resistance which is in excess of that which can be applied by the fingers of a young child.

To assist the adult user in removing the overcap of the present invention from a container, such as an aerosol container, suitable legends may be applied to the pressure panels 24 and 24*a*, e.g., "PRESS HERE" or other suitable instructions. Alternatively, the instructions can be applied to the top of the container with arrows pointing to the pressure panels 24 and 24*a* of the overcap.

The child-resistant safety overcap of the present invention provides an advantageous feature in that it is not necessary that one be able to determine the location of the pressure application points visually as is the case in a number of aerosol safety overcaps presently on the market which utilize inner and outer skirts. These caps utilize a completely closed outer skirt, and it is necessary to visually determine the locations on the outer skirt where pressure must be applied to be able to remove the overcap from the container. Thus, if a user were to attempt to remove this type overcap in a nonlighted or darkened area, considerable difficulty may be encountered in finding the opposed areas to apply pressure to the outer skirt to remove the overcap. The provision of the slots and pressure panels in the overcap of the present invention permits the user to circumferentially slide the forefinger and thumb around the wall of the outer skirt of the aerosol cap in the dark and thus readily locate the two openings in the outer skirt to apply pressure to the pressure panels on the inner skirt and successfully remove the overcap without any problem.

While an adequate description of the preferred embodiment of the present invention has been shown and described for purposes of illustrating the invention, it will be quite apparent to those skilled in the safety cap art that numerous changes and modifications can be made to the overcap of the present invention without departing from the spirit and the scope of the invention.

What is claimed is:

1. A safety overcap for a container comprising:

a. a generally circular top wall;

b. a generally cylindrical outer skirt depending downwardly from said top wall, said outer skirt being provided with two opposed, generally rectangular, longitudinal openings therein extending over a major portion of the length of said skirt, said openings being of sufficient width to receive a portion of the thumb and forefinger of an adult person;

c. an inner skirt depending downwardly from said top wall within said outer skirt, said inner skirt having two opposed pressure panels of a width substantially the same as said two openings and positioned opposite of and slightly recessed from said two openings in said outer skirt whereby pressure may be applied thereto by said thumb and forefinger; and d. engaging means on said inner skirt adjacent its lower end adapted to engage said container to retain said overcap thereon, said engaging means being disengaged from said container by application of inwardly directed force from said thumb and forefinger to said two opposed pressure panels of said inner skirt to remove the overcap from the container.

2. The safety overcap of claim 1 wherein said inner skirt is generally elliptical and has its major axis aligned with said pair of opposed openings in said outer skirt.

3. The safety overcap of claim 1 wherein said engaging means includes at least one pair of opposed projections integrally formed on the lower portion of the inner wall of said inner skirt.

4. The safety overcap of claim 1 wherein at least two opposed webs interconnect said outer skirt and said inner skirt between said openings in said outer skirt.

5. The safety overcap of claim 1 wherein said openings terminate short of the lower end of said outer skirt.

6. The safety overcap of claim 1 wherein said top wall is provided with opposed recessed portions opposite said openings in said outer skirt.

7. The safety overcap of claim 1 wherein said overcap is of one-piece molded plastic construction.

* * * * *